US011377833B1

(12) United States Patent
Manrique

(10) Patent No.: US 11,377,833 B1
(45) Date of Patent: Jul. 5, 2022

(54) WATER CONSERVING TOILET DISINFECTANT DISPENSER

(71) Applicant: Javier G. Manrique, Greenacres, FL (US)

(72) Inventor: Javier G. Manrique, Greenacres, FL (US)

( * ) Notice: Subject to any disclaimer, the term of this patent is extended or adjusted under 35 U.S.C. 154(b) by 0 days.

(21) Appl. No.: 17/200,797

(22) Filed: Mar. 13, 2021

(51) Int. Cl.

| | |
|---|---|
| ***E03D 9/02*** | (2006.01) |
| ***E03D 1/38*** | (2006.01) |
| ***E03D 9/03*** | (2006.01) |
| ***E03D 11/13*** | (2006.01) |

(52) U.S. Cl.
CPC ..... *E03D 9/022* (2013.01); *E03D 1/38* (2013.01); *E03D 9/031* (2013.01); *E03D 11/13* (2013.01); *E03D 2009/024* (2013.01)

(58) Field of Classification Search
CPC ..... E03D 9/022; E03D 9/031; E03D 1/38; E03D 11/13; E03D 2009/024
USPC ..... 4/223
See application file for complete search history.

(56) References Cited

U.S. PATENT DOCUMENTS

2007/0289054 A1* 12/2007 Han ..... E03D 9/038 4/225.1
2011/0219525 A1* 9/2011 Burt ..... E03D 9/037 4/224
2012/0131739 A1* 5/2012 Burt ..... E03D 9/037 4/227.7
2019/0360187 A1* 11/2019 Aldridge ..... E03D 9/038

* cited by examiner

*Primary Examiner* — Huyen D Le

(57) ABSTRACT

A water conserving toilet disinfectant dispenser uniformly dispenses a solid disinfecting composition in the water that is flushed by the toilet, which then flows across the toilet bowl. The disinfectant dispenser includes a perforated container that retains a solid disinfecting composition. The disinfectant dispenser also includes a coupling conduit having a top end that mates with, and receives water from, a refill tube integral in toilet tank. The coupling conduit also has a bottom end that discharges the water at an angle into the overflow tube, so as to minimize splashing and water waste over the rim. The dispenser further includes a tension leg that clips to the top rim of the overflow tube to retain the dispenser in an upright position. The tension leg is elongated and has a grip layer at the inner face that maintains stability for the container, even under turbulence from water entering overflow tube.

20 Claims, 5 Drawing Sheets

WATER CONSERVING TOILET DISINFECTANT DISPENSER

FIELD OF THE INVENTION

The present invention relates generally to a water conserving toilet disinfectant dispenser. More so, the present invention relates to a disinfectant dispenser that dispenses a solid disinfecting composition in the water that is flushed by the toilet, which then flows across the surface of the toilet bowl; whereby the dispenser includes a perforated container that retains a solid disinfecting composition; and further includes a coupling conduit having a top end that mates with, and receives water from, a refill tube integral in the toilet tank, and a bottom end that discharges the water at a 15° into the sidewall of the overflow tube; and further includes a tension leg that clips to the top rim of the overflow tube to retain the dispenser in an upright position, even under turbulence from water entering the overflow tube.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, disinfectants and sanitizing agents are used to clean the inner surface of a toilet bowl. Often, disinfectant product dispensers are mounted directly in the toilet bowl. In public restrooms, it is common to use automatic metering devices which provide the disinfectant product in the water flushed by the tank. Unfortunately, such metering devices are expensive and require a fixed installation, so they are mainly intended for frequently used restrooms. At the household level, different disinfecting systems and methods are used to apply disinfectant in the toilet bowl. For example, bottled disinfectants are used, the use of which is limited to pouring a stream of the product into the toilet bowl. This technique has a very limited duration and effectiveness because the use of the tank causes the entrainment and the final elimination of the disinfectant. Further, there are racks, or cages, that retain a disinfectant agent and have a hook, so as to hang on the edge of the toilet bowl. In this manner, when the tank is used, the water assess through the rack, coming into contact with the disinfectant agent.

Typical drawbacks are that they remain in a visible position, giving the toilet bowl a negative aesthetic appearance, they are exposed to urine, rapidly becoming soiled, they make it difficult to clean the upper part of the toilet bowl and must be momentarily removed in order to leave the complete surface of the toilet bowl free to clean it. Furthermore, their arrangement at a specific point on the periphery of the toilet bowl causes the disinfectant entrained by the water flushed from the tank to act only on a limited portion of the inner surface of the toilet bowl. This can leave the toilet dirty.

Other proposals have involved systems for disinfecting the inner surface of a toilet bowl. The problem with these toilet disinfecting systems is that they do not securely couple to the overflow tube of the toilet tank. Also, the water conservation is not efficient because water splashes out of the overflow tube. Even though the above cited toilet disinfecting systems meet some of the needs of the market, a water conserving toilet disinfectant dispenser that dispenses a solid disinfecting composition in the water that is flushed by the toilet, which then flows across the surface of the toilet bowl; whereby the dispenser includes a perforated container that retains a solid disinfecting composition; and further includes a coupling conduit having a top end that mates with, and receives water from, a refill tube integral in the toilet tank, and a bottom end that discharges the water at a 15° into the sidewall of the overflow tube; and further includes a tension leg that clips to the top edge of the overflow tube to retain the dispenser in an upright position, even under turbulence from water entering the overflow tube, is still desired.

SUMMARY

Illustrative embodiments of the disclosure are generally directed to a water conserving toilet disinfectant dispenser. The disinfectant dispenser serves to dispense a solid disinfecting composition in the water that is flushed by the toilet, which then flows across the surface of the toilet bowl. The disinfectant dispenser includes a perforated container that retains a solid disinfecting composition. The disinfectant dispenser also includes a coupling conduit having a top end that mates with, and receives water from, a refill tube integral in the toilet tank. The coupling conduit also has a bottom end that discharges the water at an angle into the overflow tube, so as to minimize spillage and water waste. This sloped disposition of the coupling tube prevents water from splashing out of the overflow tube, resulting in water conservation. The disinfectant dispenser further includes a tension leg that clips to the top edge of the overflow tube to retain the dispenser in an upright position. The tension leg is elongated and has a grip at the inner face that maintains stability for the container, even under turbulence from water entering the overflow tube.

In one aspect, the water conserving toilet disinfectant dispenser, comprises:

- a container defined by multiple perforations, the container having a sidewall and a floor wall that form a cavity, a portion of the sidewall defining a mounting region;
- an arm defined by a top section and a bottom section, the arm further having an inner edge and an opposing outer edge, at least a portion of the bottom section and the inner edge being attached to the mounting region of the container;
- a handle having an upper edge and an opposing lower edge, the handle further having a mount side and a free side, the mount side being attached to the top section of the arm, whereby the handle projects from the top section of the arm, facing away from the attached container;
- a tension leg being defined by a mount end and a clip end, the tension leg further being defined by an outer face and an inner face, at least a portion of the mount end and the inner face being attached to the outer edge of the arm, whereby a gap forms between the inner face of the tension leg and the outer edge of the arm, whereby torsion is generated in the tension leg when the clip end is urged distally from the arm; and
- a coupling conduit being defined by a refill end terminating at an opening, and a discharge end terminating at an opening, the coupling conduit further being defined by a sidewall forming a channel, the channel being sized and dimensioned to enable passage of a fluid from the opening in the refill end to the opening in the discharge end, the discharge end being attached at an angle to at least a portion of the upper edge and the free side of the handle, whereby the coupling tube tilts away from the attached container.

In another aspect, the perforations define the sidewall of the container, or the floor wall of the container, or both.

In another aspect, the container defines a cylindrical shape.

In another aspect, the cavity of the container is configured to enable retention of a solid disinfecting composition.

In another aspect, the solid disinfecting composition comprises a chlorine tablet.

In another aspect, the container comprises multiple protrusions projecting from the inner surface of the container.

In another aspect, the protrusions are configured to retain the solid disinfecting composition.

In another aspect, the arm and the handle are defined by a flat configuration.

In another aspect, the handle projects from the top section of the arm at about 90 degrees.

In another aspect, the dispenser further comprises a grip panel, the grip panel disposed to overlay the inner face of the tension leg.

In another aspect, the coupling conduit attaches to the handle at an angle of about between 60 to 85 degrees from a horizontal.

In another aspect, the coupling conduit attaches to the handle at an angle of about 75 degrees from the horizontal.

In another aspect, the horizontal is colinear with the handle.

In another aspect, the refill end of the coupling conduit is configured to enable detachable mating with a refill tube for a toilet.

In another aspect, the discharge end of the coupling conduit is configured to enable discharge of the fluid into the overflow tube.

In another aspect, the sloped disposition of the coupling tube relative to the handle helps minimize spillage of the fluid from the overflow tube.

In another aspect, the gap between the tension leg and the arm is configured to enable receiving a rim of an overflow tube for a toilet.

In another aspect, the dispenser is fabricated from a polymer material.

In another aspect, the sidewall of the container is defined by an outer surface and an inner surface.

One objective of the present invention is to disinfect a toilet bowl with running water from the flushing of a toilet.

Another objective is to uniformly dispense chlorine solution into the water inside the toilet tank, and subsequently, the toilet bowl.

Another objective is to securely clamp the dispenser to the overflow tube, such that the container holding the chlorine tablet is maintained in an upright stable position, so as to prevent dislodging of the chlorine tablet from the cavity of the container.

Yet another objective is to conserve water by minimizing spillage in the toilet tank.

Yet another objective is to minimize spillage and splashing of the water flowing into the overflow tube in the toilet tank by discharging the water from the coupling conduit at an angle, towards the sidewalls of the overflow tank, rather than directly straight down into the overflow tube.

An exemplary objective is to enable the dispenser to be portable, and universal for attachment to multiple toilet tanks.

Additional objectives are to provide an inexpensive to manufacture water conserving toilet disinfectant dispenser.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 5A shows the coupling mechanism joining the refill tube to the overflow tube, and FIG. 5B shows the coupling conduit of the toilet disinfectant dispenser joining coupling the refill tube to the overflow tube at an angle, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A water conserving toilet disinfectant dispenser 100 is referenced in FIGS. 1-7. The water conserving toilet disinfectant dispenser 100, hereafter "disinfectant dispenser 100" provides a water-conservation structural and mounting configuration that enables uniform dispensing of a solid disinfecting composition 404 in the water that is flushed by the toilet, which then flows across the surface of the toilet bowl. The dispenser 100 is also lightweight, portable, and universal, so as to be easily mounted to different toilet tanks, and specifically a refill tube and an overflow tube that are integral to the toilet tank. Uniquely, the dispenser 100 has a coupling conduit that discharges water from the refill tube into the overflow tube at an angle, so that minimal spillage and splashing occurs—thereby conserving water from waste.

Figure 1:
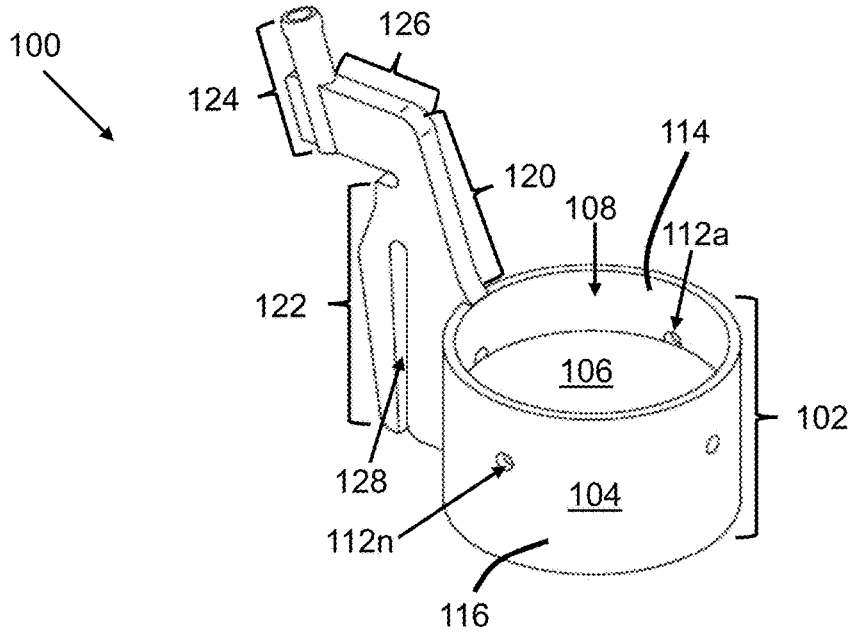
FIG. 1 illustrates a perspective view of an exemplary water conserving toilet disinfectant dispenser, in accordance with an embodiment of the present invention.
Figure 2:
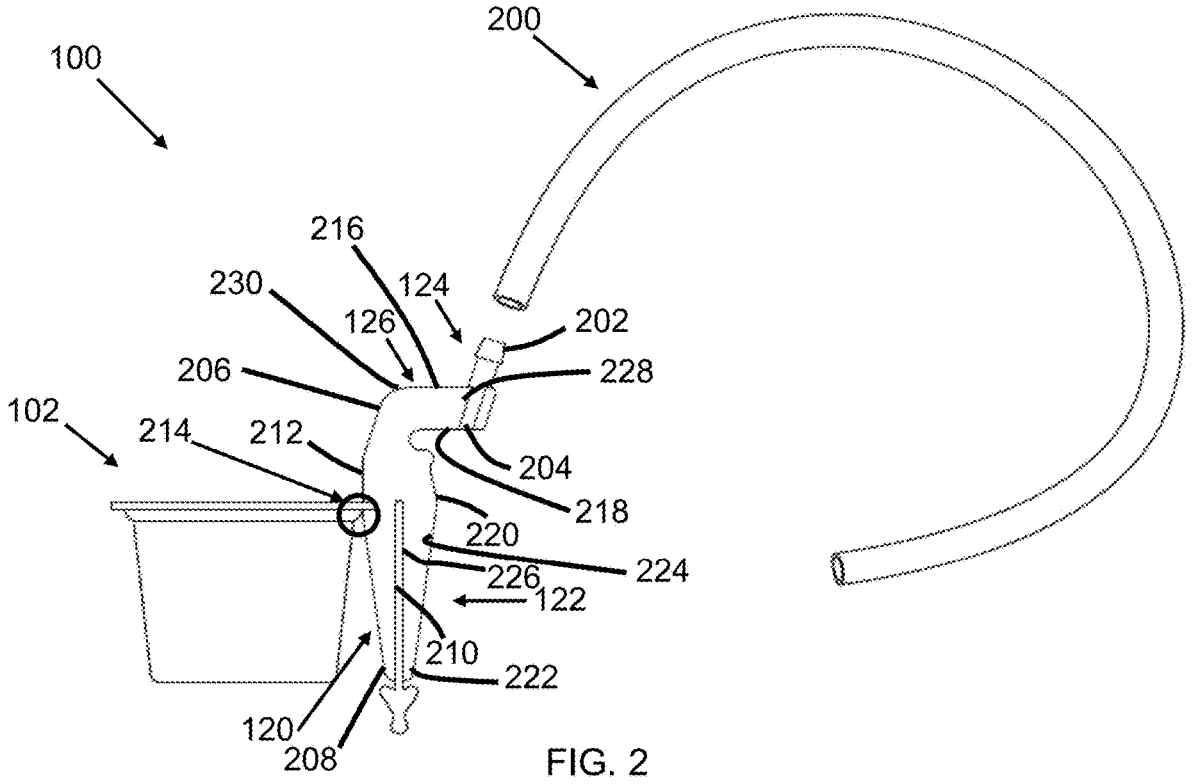
FIG. 2 illustrates a perspective view of the water conserving toilet disinfectant dispenser shown in FIG. 1, and an exemplary refill tube, in accordance with an embodiment of the present invention.

As referenced in FIGS. 1-2, the disinfectant dispenser 100 includes a perforated container 102 that retains a solid disinfecting composition 404. The disinfectant dispenser 100 also includes a coupling conduit 124 having a refill end 202 terminating at an opening, and a discharge end 204 terminating at an opening. The refill end 202 mates with, and receives water from, a refill tube 200 integral in the toilet tank. The discharged end 204 is sized and dimensioned to discharges the water at an angle into the overflow tube 400, so as to minimize spillage and water waste. This sloped disposition of the coupling conduit 124 prevents water from splashing out of the overflow tube 400, resulting in water conservation. The disinfectant dispenser 100 further includes a tension leg 122 that enables clipping to the top rim 402 of the overflow tube 400 to retain the dispenser 100 in an upright position. This can be useful during the churning inside the toilet tank during flushing.

The tension leg 122 is elongated and has a grip 602 at the inner face that maintains stability for the container 102, even under turbulence from water entering the overflow tube 400. The torsion generated in the tension leg 122 from the introduction of the overflow tube 400 fits between the arm and the tension leg maintains the container 102 in a stable position, even when turbulence from water in the toilet tank disrupts the container 102 and the solid disinfecting composition contained therein. In one non-limiting embodiment, the disinfectant dispenser 100 is fabricated from a polymer material. However, other materials may also be used.

Figure 3:
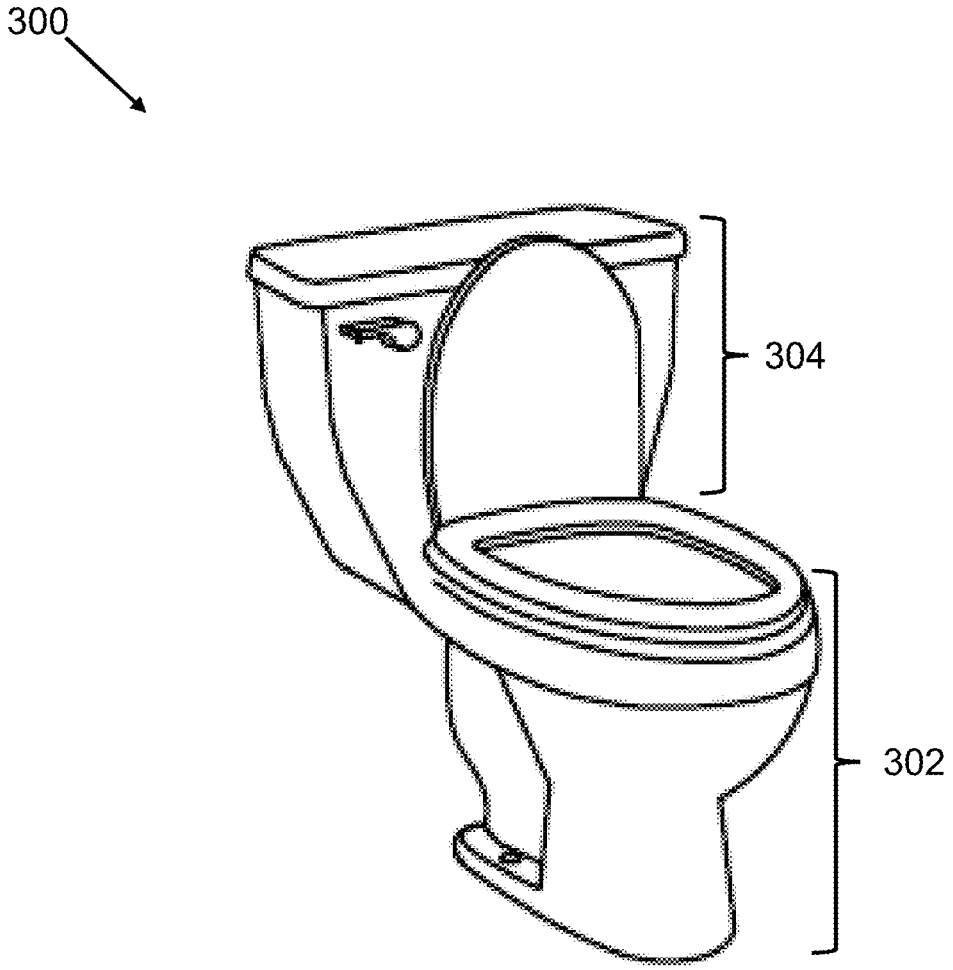
FIG. 3 illustrates a front perspective view of an exemplary standard toilet, in accordance with an embodiment of the present invention.

Turning now to FIG. 3, the disinfectant dispenser 100 is operable with a standard toilet 300, as is known in the art. The standard toilet has a toilet bowl 302 sized and dimensioned to receive waste from a user. A toilet tank 304 regulates flowage of the water into the toilet bowl 302. The standard toilet 300 works because of gravity. When a flush lever is pulled, a plug in the toilet tank 304 opens, allowing water to flow out to fill the toilet bowl 302. This flow of water can be fast and turbulent, which creates a lot of splashing that requires longer time for overflow tube to fill; thereby wasting water. Specifically, a refill tube 200 couples to the overflow tube 400 until the toilet tank is filled. When the toilet bowl 302 is full enough, gravity causes the liquid to flow out through a bend in an S trap pipe.

Looking again at FIG. 2, the disinfectant dispenser 100 comprises a container 102 that is utilized to retain a solid disinfecting composition 404. In one non-limiting embodiment, the solid disinfecting composition 404 comprises a chlorine tablet. However, in other embodiments, the solid disinfecting composition 404 may include, without limitation, sodium lauryl ether sulfate, hydrochloric acid, and cetrimonium chloride, and ammonia.

The container 102 has a sidewall 104 and a floor wall 106 that form a cavity 108. The sidewall 104 has an inner surface 114 and an outer surface 116. In one possible embodiment, the container 102 defines a cylindrical shape. However, in other embodiments, the container 102 has a spherical shape, a cube shape, a rectangular shape, a triangular shape, or an irregular shape. The container 102 is defined by multiple perforations 112*a-n*. In one non-limiting embodiment, the perforations 112*a-n* define the sidewall of the container 102, and/or the floor wall of the container 102. The perforations 112*a-n* enable uniform dispensing of chlorine solution into the water inside the toilet tank, and subsequently, the toilet bowl.

In some embodiments, the container 102 comprises multiple protrusions 702*a-n* projecting from the inner surface 114 of the container 102. In some embodiments, the protrusions 702*a-n* are configured to retain the solid disinfecting composition concentrically in the cavity of the container 102. In some embodiments, the cavity 108 of the container 102 is configured to enable retention of the solid disinfecting composition. A portion of the sidewall 104 defines a mounting region 214 that enables fixed attachment to the arm 120. This can include a small depression that allows snap-fit mating, or an adhesive applied thereto, for example.

Figure 4:
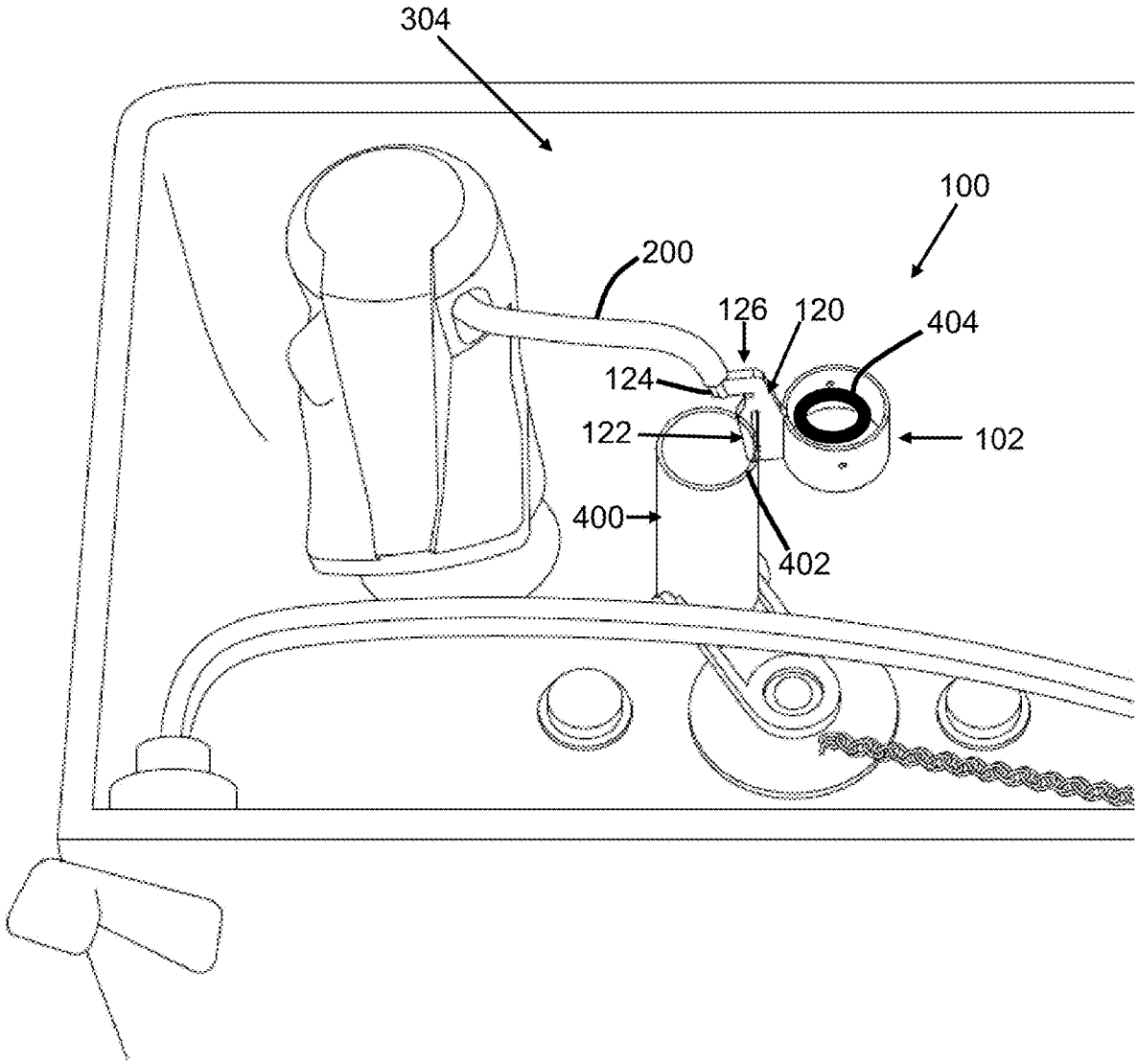
FIG. 4 illustrates a top perspective view of the water conserving toilet disinfectant dispenser, clamped onto the top rim of the overflow tube and mated with the refill tube, in accordance with an embodiment of the present invention.
Figure 5A:
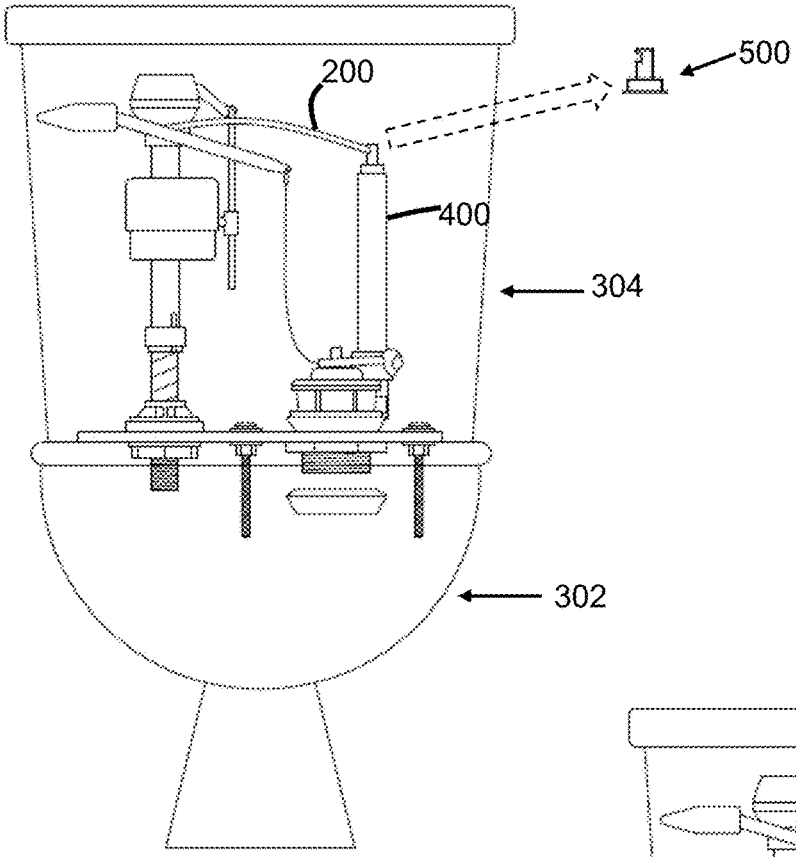
FIGS. 5A-5B illustrate sectioned views of an exemplary toilet, where
Figure 5B:
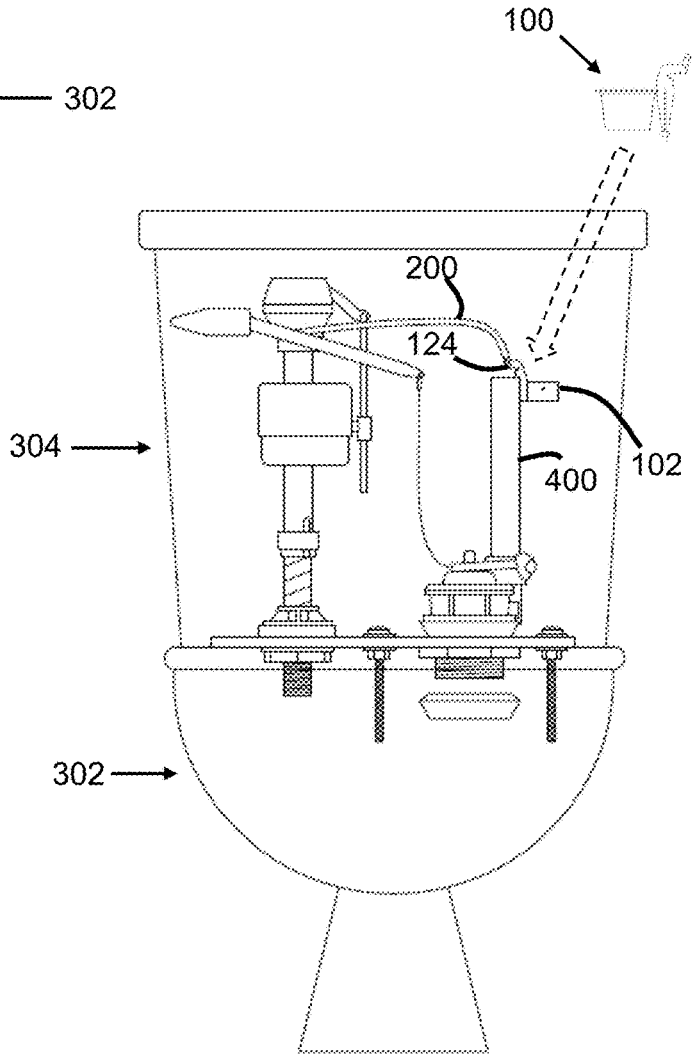

Looking now at FIG. 4, the disinfectant dispenser 100 also includes an arm 120 that is defined by a top section 206 and a bottom section 208. The arm 120 also has an inner edge 210 and an opposing outer edge 212. At least a portion of the bottom section 208 and the inner edge 210 of the arm 120 attach to the mounting region 214 of the container 102. In some embodiments, the arm 120 is defined by a flat configuration.

In some embodiments, the disinfectant dispenser 100 comprises a handle 126 that has an upper edge 216 and an opposing lower edge 218. The handle 126 also has a mount side 228 and a free side 230. In some embodiments, the handle 126 is defined by a flat configuration. The mount side of the handle 126 attaches to the top section 206 of the arm 120 in a manner that allows the handle 126 to project about horizontal from the top section of the arm, and face away from the attached container 102. In one possible embodiment, the handle 126 projects from the top section 206 of the arm 120 at about 90°.

In some embodiments, the disinfectant dispenser 100 comprises a tension leg 122 that projects outwardly in a tensioned configuration for clamping to the overflow tube. The tension leg 122 has a mount end 220 and an opposing clip end 222. The tension leg 122 is also defined by an outer face 224 and an inner face 226. At least a portion of the mount end 220 and the inner face 226 are disposed attach to the outer edge 212 of the arm 120. In this structural configuration, a gap 128 forms between the inner face 226 of the tension leg 122 and the outer edge 212 of the arm 120. In one possible embodiment, the gap 128 between the tension leg 122 and the arm 120 is configured to enable receiving an upper rim 402 of an overflow tube 400 for the toilet.

Consequently, torsion is generated in the tension leg 122 when the clip end 222 of the tension leg 122 is urged distally from the arm 120, such as when the upper rim 402 of the overflow tube 400 is introduced between the tension leg and the arm. The torsion allows the tension leg and the arm 120 to securely clamp the dispenser 100 to the overflow tube 400, such that the container 102 holding the chlorine tablet is maintained in an upright stable position, so as to prevent dislodging of the chlorine tablet from the cavity of the container 102. In some embodiments, the dispenser 100 may also have a grip panel 602. The grip panel 602 is disposed to overlay the inner face 226 of the tension leg 122 (See FIG. 6), and improve the grip to the overflow tube 400.

Turning now to FIG. 5, the disinfectant dispenser 100 comprises a coupling conduit 124 for coupling to the refill tube 200. The coupling conduit 124 is defined by a refill end 202 terminating at an opening 606, and a discharge end 204 terminating at an opening 604. The refill end 202 mates with, and receives water from, a refill tube 200 integral in the toilet tank. The opening 604 in the discharged end 204 is sized and dimensioned to enable passage of the water flowing from the refill tube 200 at an angle into the overflow tube 400 at an angle. Significantly, this angled introduction of water into the overflow tube 400 helps minimizes spillage and water waste inside the toilet tank, as less splashing occurs. This results in the flow of fluid being cut off earlier, which conserves water.

In some embodiments, the coupling conduit 124 is also defined by a sidewall 608 that forms a channel 610 that is sized and dimensioned to enable passage of the fluid, i.e., water, from the opening in the refill end to the opening in the discharge end. In one non-limiting embodiment, the channel 610 has a tubular shape. The flow of fluid through the refill tube, and subsequently the coupling conduit 124 can be fast and turbulent, which necessitates the secure clamping mechanism to the rim 402 at the overflow tube, and the angled introduction of fluid/water into the overflow tube 400.

In fitting to the toilet tank, the toilet coupling mechanism 500 detaches from the overfill tube 400 (FIG. 5A) to be replaced by the coupling conduit 124 of the disinfectant dispenser 100. Once removed, the tension leg 122 and the handle 126 are sufficiently tensioned so as to clamp to the top rim 402 of the overflow tube 400 (See FIG. 5B). The refill end of the coupling conduit 124 is configured to enable detachable mating with a refill tube 200 for the toilet. In some embodiments, the discharge end of the coupling conduit is configured to enable discharge of the fluid into the overflow tube 400. In some embodiments, the sloped disposition of the coupling tube relative to the handle helps minimize spillage of the fluid from the overflow tube.

Figure 6:
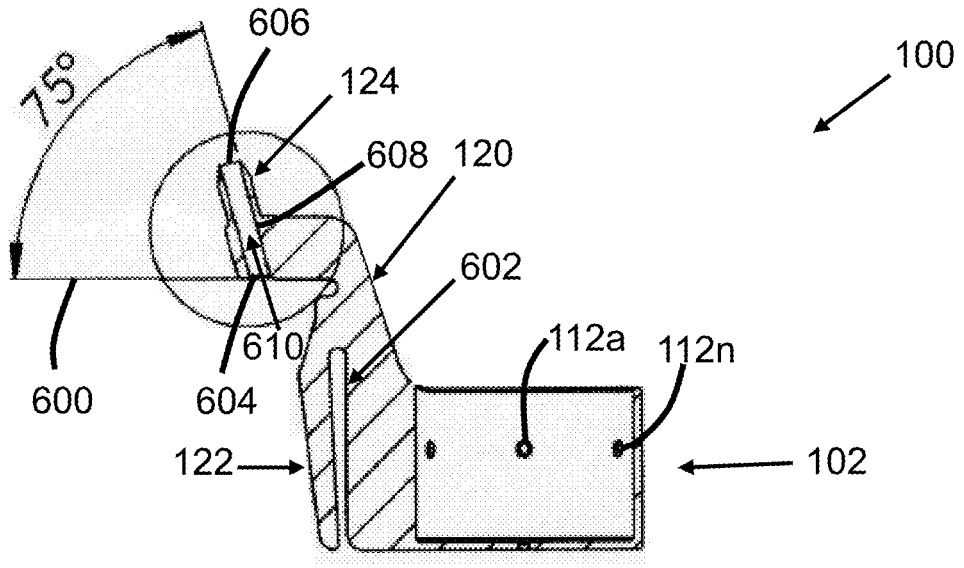
FIG. 6 illustrates a side view of the water conserving toilet disinfectant dispenser, showing the coupling conduit projecting at an angle for filling the overflow tube of the toilet, in accordance with an embodiment of the present invention.
Figure 7:
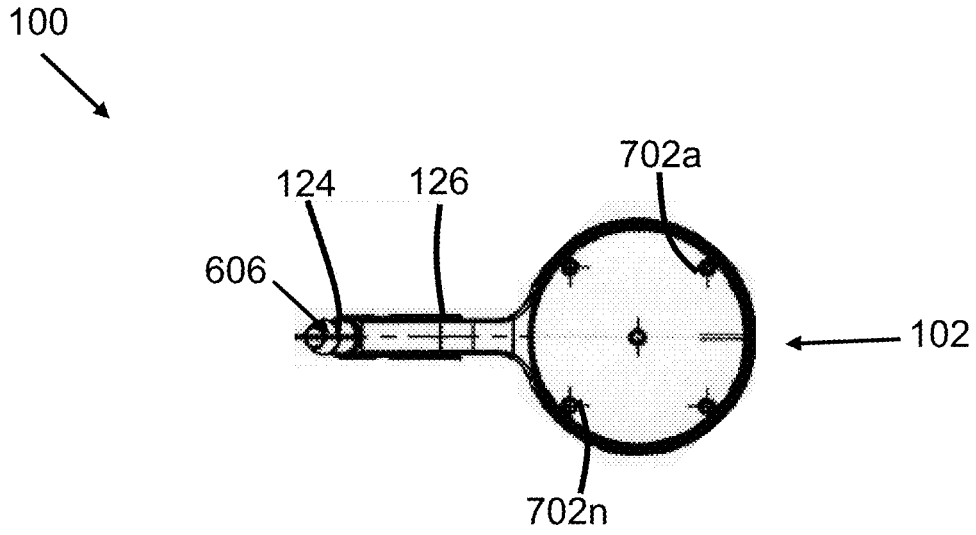
FIG. 7 illustrates a top view of the water conserving toilet disinfectant dispenser, in accordance with an embodiment of the present invention.

The discharge end of the coupling conduit 124 is attached at an angle to at least a portion of the upper edge and the free side of the handle. In other embodiments, the coupling conduit attaches to the handle at an angle of about between 60° to 85° from a horizontal 600. However, in one possible embodiment, the coupling conduit attaches to the handle at an angle of about 75° from the horizontal 600. For example, FIG. 6 illustrates a side view of the water conserving disinfectant dispenser 100, showing the coupling conduit 124 projecting at an angle for filling the overflow tube 400 of the toilet. In one non-limiting embodiment, the horizontal 600 is colinear with the handle. In this structural configuration, the coupling tube tilts away from the attached container 102.

Significantly, the angled configuration of the coupling conduit 124 discharges the fluid from the refill tube 200 towards the sidewalls of the overflow tube 400, and not directly into the level of water rising in the overflow tube 400. This angled discharge of the fluid minimizes splashing of the fluid flowing into the overflow tube by discharging the water from the coupling conduit at an angle, and towards the sidewalls of the overflow tank, rather than directly straight down into the overflow tube (See FIG. 7). This angle of introduction conserves water by minimizing spillage in the toilet tank. It is known in the art that a direct impact is greater than an angled impact, which in this case, creates less splash and spillage over the rim 402 of the overflow tube 400.

In summary of the advantages provides by the disinfectant dispenser 100, the angle of the conduit tube allows the discharged water to hit the side of the overflow tube, rather than directly striking the water level at a 90°. This angled discharge of the water coming from the refill tube helps prevent splashing, and thereby allows the overflow tube to fill faster. This saves water, i.e., water conservation. Also, the grip between the tension leg and the arm—and the grip layer covering them—helps retain the container with the solid disinfecting composition in a more stable, upright position, so that there is less chance the solid disinfecting composition disengages from the cavity of the container, even inside the toilet tank where the flow of water is turbulent.

In conclusion, the disinfectant dispenser 100 uniformly dispenses a solid disinfecting composition in the water that is flushed by the toilet, which then flows across the toilet bowl. The disinfectant dispenser 100 includes a perforated container 102 that retains a solid disinfecting composition. The disinfectant dispenser 100 also includes a coupling conduit having a top end that mates with, and receives water from, a refill tube 200 integral in the toilet tank. The coupling conduit also has a bottom end that discharges the water at an angle into the overflow tube, so as to minimize spillage and water waste. The disinfectant dispenser 100 further includes a tension leg that clips to the top edge of the overflow tube to retain the disinfectant dispenser 100 in an upright position. The tension leg is elongated and has a grip at the inner face that maintains stability for the container 102, even under turbulence from water entering the overflow tube.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A water conserving toilet disinfectant dispenser, the dispenser comprising:

a container defined by multiple perforations, the container having a sidewall and a floor wall that form a cavity, a portion of the sidewall defining a mounting region;

an arm defined by a top section and a bottom section, the arm further having an inner edge and an opposing outer edge, at least a portion of the bottom section and the inner edge being attached to the mounting region of the container;

a handle having an upper edge and an opposing lower edge, the handle further having a mount side and a free side, the mount side being attached to the top section of the arm, whereby the handle projects from the top section of the arm, facing away from the attached container;

a tension leg being defined by a mount end and a clip end, the tension leg further being defined by an outer face and an inner face, at least a portion of the mount end and the inner face being attached to the outer edge of the arm, whereby a gap forms between the inner face of the tension leg and the outer edge of the arm, whereby torsion is generated in the tension leg when the clip end is urged distally from the arm; and a coupling conduit being defined by a refill end terminating at an opening, and a discharge end terminating at an opening, the coupling conduit further being defined by a sidewall forming a channel, the channel being sized and dimensioned to enable passage of a fluid from the opening in the refill end to the opening in the discharge end, the discharge end being attached at an angle to at least a portion of the upper edge and the free side of the handle, whereby the coupling tube tilts away from the attached container.

2. The dispenser of claim 1, wherein the perforations define the sidewall of the container, or the floor wall of the container, or both.

3. The dispenser of claim 1, wherein the container defines a cylindrical shape.

4. The dispenser of claim 1, wherein the cavity of the container is configured to enable retention of a solid disinfecting composition.

5. The dispenser of claim 4, wherein the solid disinfecting composition comprises a chlorine tablet.

6. The dispenser of claim 1, wherein the container is defined by an outer surface and an inner surface.

7. The dispenser of claim 6, wherein the container comprises multiple protrusions projecting from the inner surface of the container.

8. The dispenser of claim 7, wherein the protrusions are configured to retain the solid disinfecting composition.

9. The dispenser of claim 1, wherein the arm and the handle are defined by a flat configuration.

10. The dispenser of claim 1, wherein the handle projects from the top section of the arm at about 90 degrees.

11. The dispenser of claim 1, further comprising at least one grip panel, the at least one grip panel disposed to overlay the inner face of the tension leg and the outer edge of the arm.

12. The dispenser of claim 1, wherein the coupling conduit attaches to the handle at an angle of about between 60 to 85 degrees from a horizontal.

13. The dispenser of claim 12, wherein the coupling conduit attaches to the handle at an angle of about 75 degrees from the horizontal.

14. The dispenser of claim 13, wherein the horizontal is colinear with the handle.

15. The dispenser of claim 1, wherein the refill end of the coupling conduit is configured to enable detachable mating with a refill tube for a toilet.

16. The dispenser of claim 15, wherein the discharge end of the coupling conduit is configured to enable discharge of the fluid into the overflow tube.

17. The dispenser of claim 16, wherein the angled disposition of the coupling tube relative to the handle helps minimize spillage of the fluid from the overflow tube.

18. The dispenser of claim 17, wherein the gap between the tension leg and the arm is configured to enable receiving a rim of an overflow tube for the toilet.

19. A water conserving toilet disinfectant dispenser, the dispenser comprising:

a container defined by multiple perforations, the container having an inner surface, an outer surface, a sidewall, and a floor wall, the sidewall and the floor wall forming a cavity, a portion of the sidewall defining a mounting region;

multiple protrusions projecting from the inner surface of the container, the protrusions being configured to enable retention of a solid disinfecting composition in the cavity of the container;

an arm defined by a top section and a bottom section, the arm further having an inner edge and an opposing outer edge, at least a portion of the bottom section and the inner edge being attached to the mounting region of the container;

a handle having an upper edge and an opposing lower edge, the handle further having a mount side and a free side, the mount side being attached to the top section of the arm, whereby the handle projects from the top section of the arm, facing away from the attached container, whereby the handle projects from the top section of the arm at about 90 degrees;

a tension leg being defined by a mount end and a clip end, the tension leg further being defined by an outer face and an inner face, at least a portion of the mount end and the inner face being attached to the outer edge of the arm, whereby a gap forms between the inner face of the tension leg and the outer edge of the arm, whereby torsion is generated in the tension leg when the clip end is urged distally from the arm, whereby the gap between the tension leg and the arm is configured to enable receiving a rim of an overflow tube for a toilet;

at least one grip panel disposed to overlay the inner face of the tension leg and the outer edge of the arm; and a coupling conduit being defined by a refill end terminating at an opening, and a discharge end terminating at an opening, the refill end of the coupling conduit being configured to enable detachable mating with a refill tube for the toilet, the discharge end of the coupling conduit being configured to enable discharge of the fluid into the overflow tube, the coupling conduit further being defined by a sidewall forming a channel, the channel being sized and dimensioned to enable passage of a fluid from the opening in the refill end to the opening in the discharge end, the discharge end being attached at an angle to at least a portion of the upper edge and the free side of the handle, whereby the coupling conduit attaches to the handle at an angle of about between 60 to 85 degrees from a horizontal, whereby the coupling tube tilts away from the attached container.

20. A water conserving toilet disinfectant dispenser, the dispenser consisting of:

a cylindrically shaped container defined by multiple perforations, the container having an inner surface, an outer surface, a sidewall, and a floor wall, the sidewall and the floor wall forming a cavity, a portion of the sidewall defining a mounting region;

multiple protrusions projecting from the inner surface of the container, the protrusions being configured to enable retention of a chlorine tablet in the cavity of the container;

an arm defined by a top section and a bottom section, the arm further having an inner edge and an opposing outer edge, at least a portion of the bottom section and the inner edge being attached to the mounting region of the container;

a handle having an upper edge and an opposing lower edge, the handle further having a mount side and a free side, the mount side being attached to the top section of the arm, whereby the handle projects from the top section of the arm, facing away from the attached container;

a tension leg being defined by a mount end and a clip end, the tension leg further being defined by an outer face and an inner face, at least a portion of the mount end and the inner face being attached to the outer edge of the arm, whereby a gap forms between the inner face of the tension leg and the outer edge of the arm, whereby torsion is generated in the tension leg when the clip end is urged distally from the arm, whereby the gap between the tension leg and the arm is configured to enable receiving a rim of an overflow tube for a toilet;

at least one grip panel disposed to overlay the inner face of the tension leg and the outer edge of the arm; and a coupling conduit being defined by a refill end terminating at an opening, and a discharge end terminating at an opening, the refill end of the coupling conduit being configured to enable detachable mating with a refill tube for the toilet, the discharge end of the coupling conduit being configured to enable discharge of the fluid into the overflow tube, the coupling conduit further being defined by a sidewall forming a channel, the channel being sized and dimensioned to enable passage of a fluid from the opening in the refill end to the opening in the discharge end, the discharge end being attached at an angle to at least a portion of the upper edge and the free side of the handle, whereby the coupling conduit attaches to the handle at an angle of about 75 degrees from a horizontal, whereby the coupling tube tilts away from the attached container.

* * * * *